US007490501B2

(12) United States Patent
Endo

(10) Patent No.: US 7,490,501 B2
(45) Date of Patent: Feb. 17, 2009

(54) METHOD OF PROCESSING FORMED PRODUCT, AND METAL COPE AND METAL DRAG USED FOR THE METHOD

(75) Inventor: Shigeru Endo, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 288 days.

(21) Appl. No.: 10/529,789

(22) PCT Filed: Sep. 30, 2003

(86) PCT No.: PCT/JP03/12507

§ 371 (c)(1),
(2), (4) Date: Mar. 30, 2005

(87) PCT Pub. No.: WO2004/030842

PCT Pub. Date: Apr. 15, 2004

(65) Prior Publication Data

US 2006/0027626 A1 Feb. 9, 2006

(30) Foreign Application Priority Data

Oct. 1, 2002 (JP) ..... 2002-289207

(51) Int. Cl.
*B21D 28/00* (2006.01)

(52) U.S. Cl. ..... 72/333; 72/386; 29/414

(58) Field of Classification Search ..... 72/330, 72/404, 405.1, 325, 326, 333, 386, 380; 29/413, 29/414

See application file for complete search history.

(56) References Cited

U.S. PATENT DOCUMENTS

| | | | | |
|---|---|---|---|---|
| 4,266,310 | A * | 5/1981 | Perrault et al. | 470/25 |
| 5,548,885 | A | 8/1996 | Yamada | |
| 5,640,873 | A * | 6/1997 | Costabile | 72/316 |
| 5,741,105 | A * | 4/1998 | Schubert et al. | 413/25 |
| 6,065,323 | A | 5/2000 | Arduino et al. | |
| 6,151,947 | A | 11/2000 | Arduino et al. | |
| 2003/0115926 | A1 * | 6/2003 | Cutshall et al. | 72/404 |

FOREIGN PATENT DOCUMENTS

| | | |
|---|---|---|
| EP | 0618660 | 10/1994 |
| JP | 61-289920 | 12/1986 |
| JP | 64-87018 | 3/1989 |

(Continued)

OTHER PUBLICATIONS

English Language abstract of JP 7-164058.

(Continued)

*Primary Examiner*—Dana Ross
*Assistant Examiner*—Debra M Sullivan
(74) *Attorney, Agent, or Firm*—Greenblum & Bernstein, P.L.C.

(57) ABSTRACT

A method is provided for processing a product formed by a punch press. The method includes leaving a micro joint connecting a workpiece to a raw material forming the product when forming a slit in the workpiece along an outer shape of the raw material. The method also includes forming the product by bending a bending process portion downward on the basis of a cooperation of an upper metal mold and a lower metal mold. The method further includes dropping the product by separating the connection between the product and the workpiece by the micro joint.

12 Claims, 7 Drawing Sheets

FOREIGN PATENT DOCUMENTS

| | | | |
|---|---|---|---|
| JP | 3-91123 | | 9/1991 |
| JP | 5-88714 | | 12/1993 |
| JP | 5-317990 | | 12/1993 |
| JP | 6-015378 | | 1/1994 |
| JP | 7-32066 | | 2/1995 |
| JP | 7-164058 | | 6/1995 |
| JP | 2545176 | | 7/1996 |
| JP | 8-323428 | | 12/1996 |
| JP | 11-504570 | A | 4/1999 |
| JP | 2000-024716 | | 1/2000 |
| JP | 2000-84630 | | 3/2000 |
| JP | 2000-153321 | | 6/2000 |
| JP | 2001-277058 | | 10/2001 |
| WO | 96/24446 | | 8/1996 |
| WO | 98/53931 | | 12/1998 |

OTHER PUBLICATIONS

English Language abstract of JP 8-323428.
English Language abstract of JP 2000-24716.
English Language abstract of JP 61-289920.
English Language abstract of JP 5-317990.
English Language abstract of JP 2000-153321.
English Language abstract of JP 2001-277058.
English Language abstract of JP 64-87018.
English Language abstract of JP 2000-84630.
English Language abstract of JP 7-32066.
English Language abstract of JP 6-015378.
English Language Abstract of JP 11-504570 A, Apr. 27, 1999.

* cited by examiner

METHOD OF PROCESSING FORMED PRODUCT, AND METAL COPE AND METAL DRAG USED FOR THE METHOD

TECHNICAL FIELD

The present invention relates to a method of processing a formed product which is partly bent, for example, by a punch press, such as a turret punch press or the like, and upper and lower metal molds used for the method, and more particularly to a processing method of processing a formed product in which a bending direction of a bending piece is set to the same as a generating direction of a burr generated at a time of punching an outer shape of a product shape, and upper and lower metal molds used for the process.

BACKGROUND ART

In conventional, in the case of applying a bending process to a part of a workpiece by a punch press, a workpiece is moved and positioned in X and Y directions with respect to a processing position, and a slit is processed along an outer shape of a raw material forming the formed product. Further, a slit process is applied also to a periphery of a portion to be bent in a raw material forming the formed product, and a portion surrounded by the slit process is thereafter bent upward, whereby the forming process is executed by raising the portion surrounded by the slit process. As a prior example, there exists a prior art disclosed in Japanese Patent No. 2545176. The prior art is structured such as to bend a bending piece upward by moving up a die chip provided in a lower mold in a state in which the workpiece is fixed by the upper and lower metal molds.

However, when applying a nibbling process of executing the slit process, and a punching operation to an appropriate position of a raw material forming the formed product, a burr is generated in a lower surface of the workpiece. Further, since a surface in a side surrounded and raised by the slit process, that is, an upper surface side of the workpiece forms an inner portion side of the formed product, and a lower surface side of the workpiece in which the burr is generated forms an outer portion side of the formed product, there is a problem that deburring is required.

The present invention is made for the purpose of solving the problem mentioned above, and an object of the present invention is to provide a processing method which can omit deburring by setting a burr generating direction to the same direction (back surface) as a bending direction of a bending piece, and a metal mold used for the processing method.

DISCLOSURE OF THE INVENTION

In order to achieve the object mentioned above, in accordance with a first aspect of the present invention, there is provided a processing method of processing a formed product by a punch press, comprising: (a) a step of leaving a micro joint connecting a workpiece to a raw material for the formed product at a time of forming a slit in the workpiece along an outer shape of the raw material; (b) a step of forming the formed product by positioning a bending process portion of the raw material on a lower metal mold and bending the bending process portion downward on the basis of a cooperation of an upper metal mold and the lower metal mold; and (c) a step of dropping the formed product by separating the connection between the formed product and the workpiece by the micro joint.

In accordance with a second aspect of the present invention, there is provided an upper metal mold comprising: a punch guide supported to an upper mold holder in a punch press so as to be movable upward and downward; a punch body provided within the punch guide so as to be movable upward and downward; and a punch body provided in a lower end portion of the punch body, wherein a bending process portion is provided in a lower end portion of the punch chip so as to protrude to a side portion, and the punch chip is provided so as to be movable in a protruding direction of the bending process portion with respect to the punch body.

In accordance with a third aspect of the present invention, there is provided an upper metal mold as recited in the second aspect, further comprising a pressure moving mechanism for pressure moving the punch chip in the protruding direction of the bending process portion at a time when the punch body moves downward.

In accordance with a fourth aspect of the present invention, there is provided an upper metal mold as recited in the second aspect or the third aspect, wherein the pressure moving mechanism comprises: an inclined surface formed in an opposite side to the protruding direction of the bending process portion in the punch chip; and a punch chip pressing member provided in a lower portion of the punch guide, the pressing member being slidable with the inclined surface.

In accordance with a fifth aspect of the present invention, there is provided a lower metal mold comprising: a die main body detachable with respect to a lower mold holder of a punch press, the die main body having a die hole formed therein; and a plurality of bending process edges formed at a plurality of positions in an inner peripheral edge of the die hole, the bending process edges bending a workpiece, wherein each of a plurality of dimensions from a center of the die hole to the plurality of bending process edges is differentiated so as to be capable of corresponding to the workpieces having different thicknesses.

In accordance with a sixth aspect of the present invention, there is provided a lower metal mold comprising: a die main body detachable with respect to a lower mold holder of a punch press, the die main body having a die hole formed therein; and a die chip structuring a part of an inner peripheral edge of the die hole and provided with a bending process edge for executing a bending process of a workpiece, wherein the die chip is provided so as to be detachable with respect to the die main body.

As is understood from the description mentioned above, in accordance with the present invention, it is possible to set the burr generating direction and the bending direction of the bending piece, for example, at a time of punching the outer shape of the formed product and processing a punched hole, to the back surface side, and it is possible to omit the workpiece for removing the burr generated in the formed product, whereby it is possible to solve the conventional problem mentioned above.

Further, in accordance with the structure of the upper metal mold, it is possible to execute an over-bending while taking a spring back into consideration, at a time of bending the bending piece in the downward direction.

Further, in accordance with the structure of the lower metal mold, it is possible to easily correspond to various thicknesses of the workpiece.

BEST MODE FOR CARRYING OUT THE INVENTION

A description will be in detail given below of embodiments of a processing method of a formed product in accordance with the present invention, and an upper metal mold and a lower metal mold used for the method.

Figure 1:
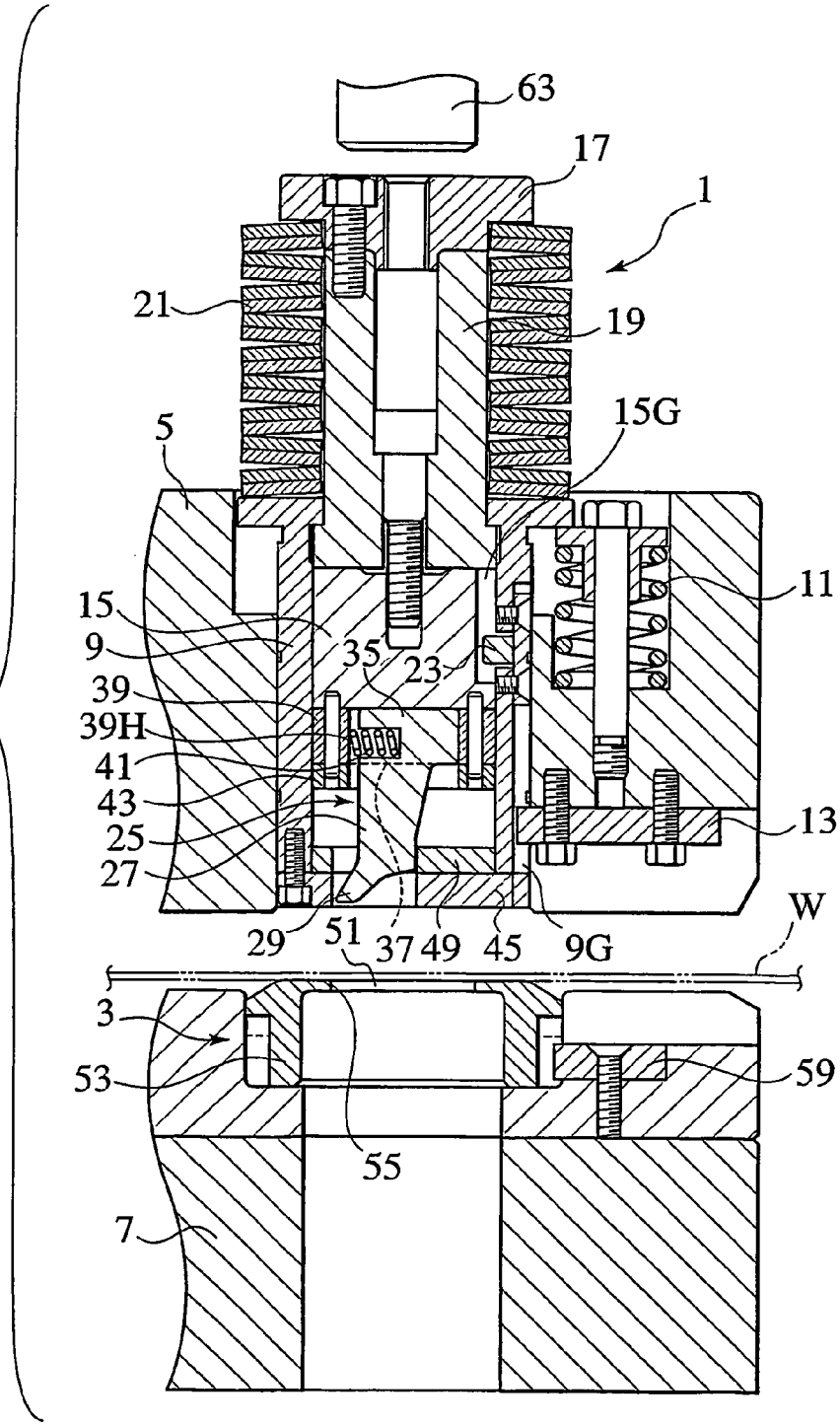
FIG. 1 is a cross sectional explanatory view of an upper metal mold and a lower metal mold in accordance with an embodiment of the present invention.
Figure 2:
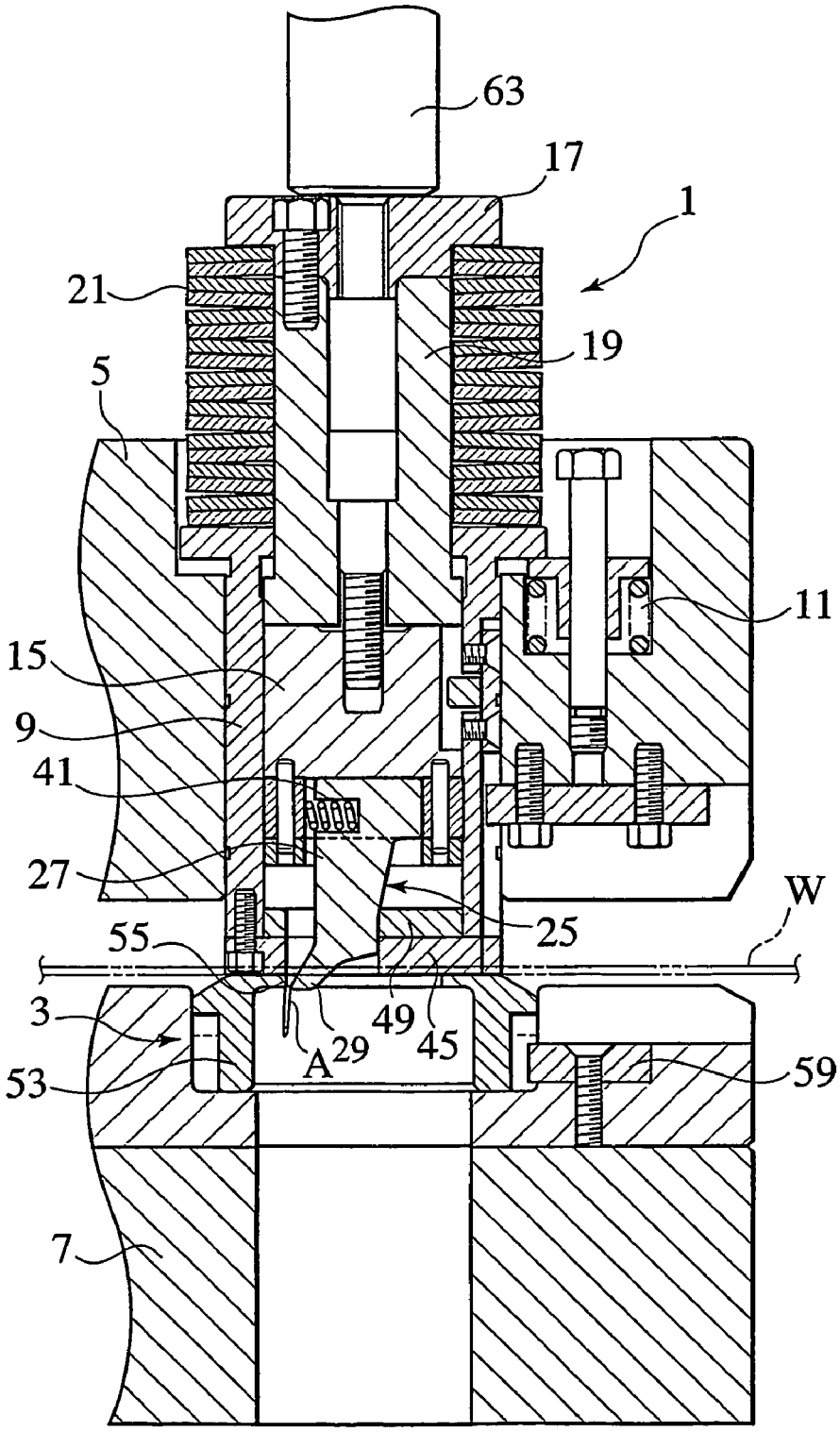
FIG. 2 is a cross sectional explanatory view of a bending process state.

First, a description will be given in detail of a structure of an upper metal mold in accordance with the present invention with reference to FIG. 1. Referring to FIG. 1, a metal mold apparatus in accordance with an embodiment of the present invention is constituted by an upper metal mold 1 and a lower metal mold 3, the upper metal mold 1 is detachably loaded to an upper mold holder 5 of a punch press (not shown), and the lower metal mold 3 is detachably loaded to a lower mold holder 7.

The upper and lower metal mold holders 5 and 7, for example, correspond to upper and lower turrets in a turret punch press. In this case, since this kind of punch press is known, a detailed description of the punch press will be omitted.

The upper metal mold 1 is provided with a tubular punch guide 9 which is fitted into an upper mold loading hole formed in the upper mold holder 5 so as to be movable upward and downward. The punch guide 9 is supported by a lifter spring 11 provided at a plurality of positions of the upper mold holder 5 so as to be movable upward and downward, and a key groove 9G in a vertical direction engaging with a key 13 fixed to the upper mold hold 5 is formed in an outer peripheral surface of the punch guide 9.

A punch body 15 is fitted into the punch guide 9 so as to be movable upward and downward, and a punch driver 19 having a punch head 17 fixed to an upper end portion thereof is integrally fixed to an upper portion of the punch body 15 by a bolt Further, a strip spring 21 is elastically provided between the punch head 17 and the punch guide 9.

A key groove 15G in a vertical direction is formed in the punch body 15, and a key 23 fixed to the punch guide 9 is engaged with the key groove 15G. Further, a punch chip 25 for bending a bending piece A of a raw material C downward is attached to a lower surface of the punch body 15 so as to be slightly movable in a horizontal direction (a horizontal direction in FIG. 1).

A bending process portion 29 for bending the bending piece A is provided in a lower end portion of a chip main body 27 of the punch chip 25, and the bending process portion 29 protrudes in a slightly moving direction of the punch chip 25. Further, an approximately vertical sliding surface 31 (refer to FIG. 3A) is formed in a protruding direction of the bending process portion 29 of the punch chip 25, that is, an opposite side to the protruding side, and an inclined surface 33 is formed in an upper portion of the sliding surface 31. The inclined surface 33 is inclined so as to be apart from the protruding direction of the bending process portion 29 toward an upper side.

A head portion 35 in which an upper surface is brought into contact with a lower surface of the punch body 15 is formed in an upper portion of the chip main body 27 in the punch chip 25, and a locking portion 37 protruding in a direction orthogonal to the slightly moving direction of the chip main body 27 (a direction perpendicular to the paper surface in FIG. 1) is formed in a lower portion of the head portion 35.

The head portion 35 of the chip main body 27 is fitted into a guide hole 39H formed in a guide ring 39 fixed to the lower surface of the punch body 15 so as to be slightly movable in a horizontal direction in FIG. 1, and an appropriate elastic member 41 such as a coil spring or the like is elastically provided between the guide ring 39 and the head portion 35. The elastic member 41 is exemplified as one example of a pressure energizing member for pressure energizing the chip main body 27 in the opposite direction to the protruding side of the bending process portion 29.

Further, in order to prevent the punch chip 25 from falling down, a support member 43 slidably locking and supporting the locking portion 37 formed in the head portion 35 in the punch chip 25 is integrally attached to a lower portion of the guide ring 39.

There is provided a pressure moving mechanism for pressure moving the punch chip 25 to a protruding side of the bending process portion 29 against an energizing force of the elastic member 41. The pressure moving mechanism is in more detail structured by the following portions. First, a plate presser foot 45 is integrally attached to a lower end portion of the punch guide 9, and a punch chip pressing member 49 is provided in an upper surface of the plate presser foot 45. A slidable contact surface 47 slidable with the sliding surface 31 and the inclined surface 33 of the chip main body 27 is formed in a side surface of the punch chip pressing member 49 (a protruding side surface of the bending process portion 29).

Figure 3B:
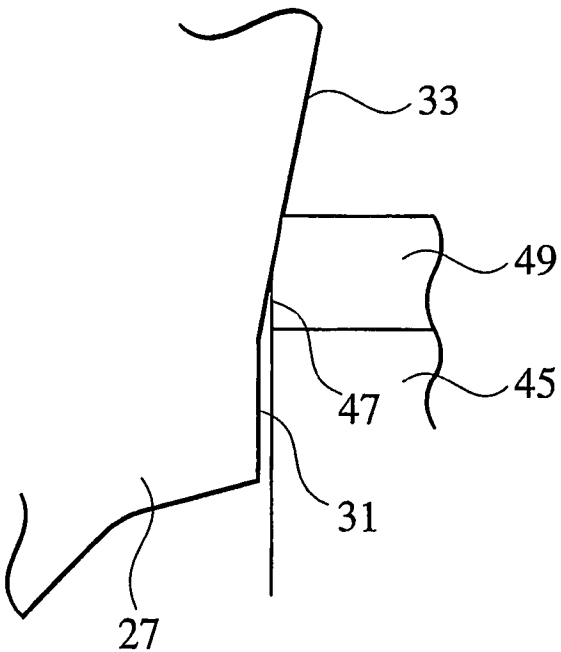
FIGS. 3A and 3B are explanatory views showing a shape of a main portion of a punch chip.
Figure 3A:
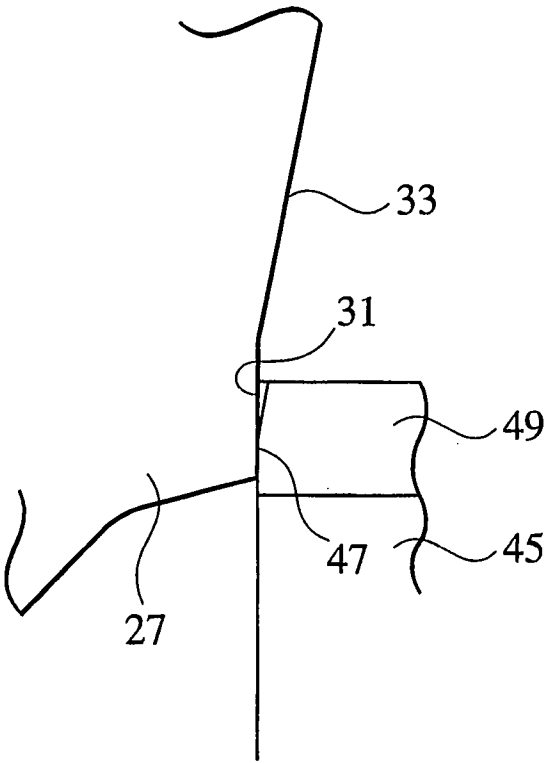

On the other hand, a lower portion side of the slidable contact surface 47 forms, as mentioned above, the approximately vertical surface slidable with the sliding surface 31 of the punch chip 25, as shown in FIG. 3A. Further, an upper portion side of the slidable contact surface 47 forms an inclined surface slidable with the inclined surface 33 of the punch chip 25, as shown in FIG. 3B.

As an operation will be described in detail later, the inclined surface 33 brings the upper portion side of the slidable contact surface 47 into slidable contact by the pressure moving mechanism, whereby the punch chip 25 is pressed in a leftward direction in FIG. 1 and is moved in the same direction.

Figure 4:
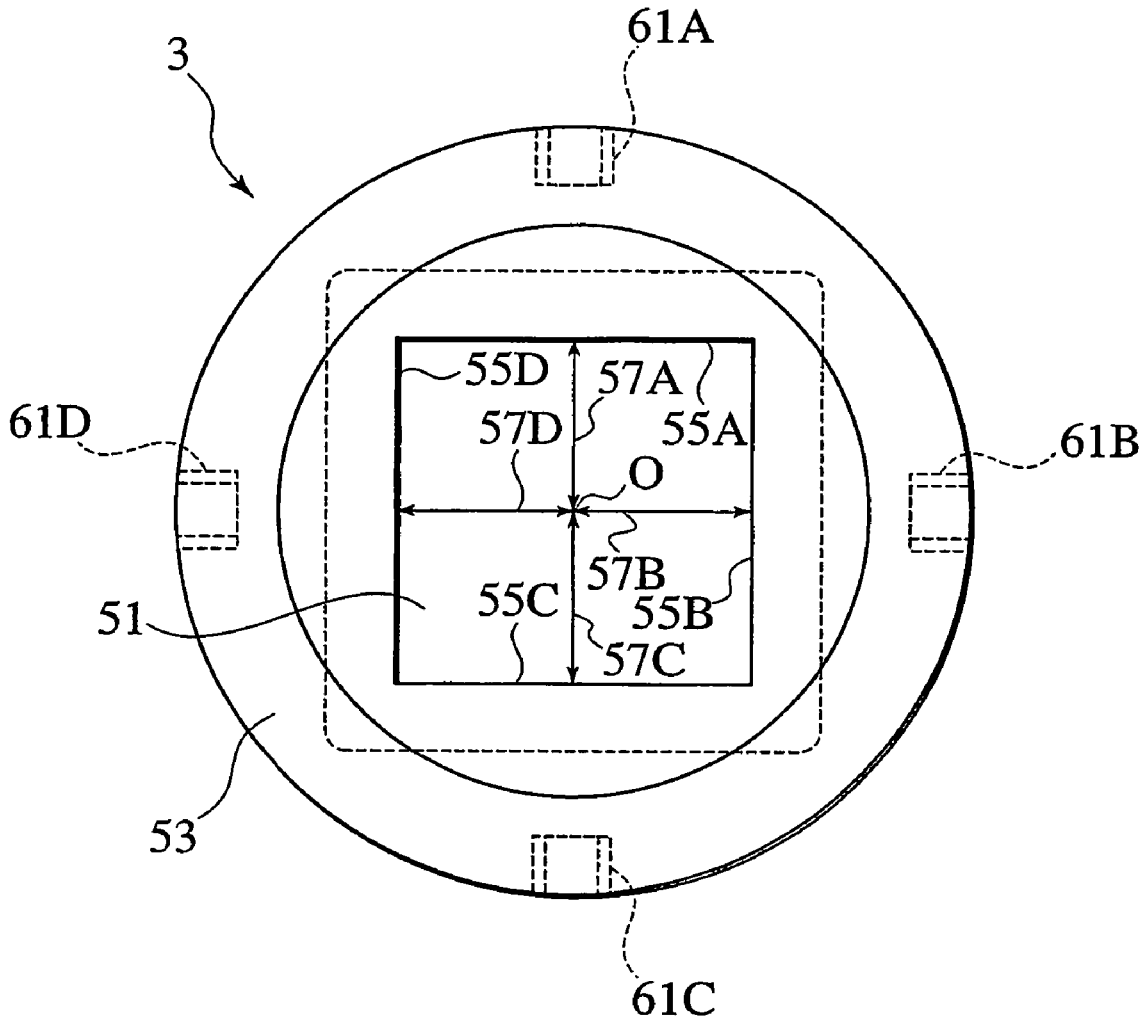
FIG. 4 is a plan explanatory view of a lower metal mold.

On the other hand, the lower metal mold 3 is constituted by a die main body 53 forming a comparatively large die hole 51 capable of dropping down the formed product B. Bending process edges 55A, 55B, 55C and 55D (refer to FIG. 4) for executing the bending process of the workpiece are formed at a plurality of positions in an inner peripheral edge of the die hole 51. The bending process edges 55A to 55D are formed as inclined surfaces which are slightly inclined taking a spring back of the workpiece into consideration. In other words, the die hole 51 is formed as a taper shape entirely.

In more detail, the taper shape is formed so as to be expanded in accordance that the processing edge 55 goes to a lower side. In other words, an upper corner portion of each of the bending process edges 55A to 55D is formed at a slightly acute angle, for example, at 89 degrees, so that the workpiece is bent at 89 degrees and becomes thereafter at 90 degrees due to the spring back mentioned above.

Dimensions 57A, 57B, 57C and 57D from a center O of the die hole 51 to the respective bending process edges 55A, 55B, 55C and 55D are made different so as to correspond to a change of thickness of the workpiece to be bent. In other words, when executing the bending process of the workpiece in cooperation with the punch chip 25 of the upper metal mold 1, the structure is made such that the clearance with respect to the bending process portion 29 of the chip main body 27 changes in correspondence to the thickness of the workpiece. Further, key grooves 61A to 61D which are freely engaged with and disengaged from a key 59 provided in the lower mold holder 7 side are formed at positions corresponding to the respective bending process edges 55A to 55D in the outer peripheral surface of the die main body 53.

In this case, each of the bending process edges 55A to 55D is exemplified as a flat surface, however, may be formed as a convex or concave curved surface in accordance with a forming aspect of the bending piece A mentioned above. Further, the respective dimensions 57A to 57D may be different dimensions, or may be equal dimensions in adjacent or opposing dimensions.

In this case, in the structure mentioned above, when relatively moving and positioning the plate-like work with respect to the processing position of the punch press and forming the slits S1 and S2 along the outer shape of the raw material C in accordance with the nibbling process or the like together with applying the punching process of the punching hole H to the raw material C forming the formed product B, the slits S1 and S2 are processed while leaving a micro joint connecting the workpiece W and the raw material C. In the case of processing the slits S1 and S2, the process is not limited to the nibbling process, and it is possible to process the slits S1 and S2 in accordance with a pursuit process (slotting process) or a laser process. In the case that the punching hole H and the slits S1 and S2 are processed as mentioned above, the burr is generated in the lower surface at a time of processing.

Thereafter, by relatively moving and positioning the workpiece W to the processing position by means of the upper metal mold 1 and the lower metal mold 3, positioning a bending position E of the bending piece A in the raw material C with respect to the desired bending process edge 55 which is previously set in correspondence to the thickness of the workpiece W in the lower metal mold 3, moving downward a ram (striker) 63 provided in the punch press so as to be movable upward and downward, and pressing and downward moving the punch head 17 in the upper metal mold 1, an entire of the upper metal mold 1 is moved downward against a weak energizing force of the lifter spring 11.

As mentioned above, when the upper metal mold 1 is moved downward, and the plate presser foot 45 provided in the lower end portion of the punch guide 9 is brought into contact with the workpiece W on the lower metal mold 3, the downward movement of the punch guide 9 is stopped, and the stripper ring 21 is gradually compressed. Accordingly, the workpiece W is firmly pressure fixed to the lower metal mold 3.

When further moving downward the ram 63 in a state in which the workpiece W is pressure fixed to the lower metal mold 3 by the plate presser foot 45, the punch body 15 is relatively moved downward with respect to the punch guide 9, and the bending piece A of the raw material C is bent downward at the bending position E by the bending process portion 29 in the punch chip 25 provided in the lower portion of the punch body 15.

As mentioned above, since the punch chip 25 is relatively moved downward with respect to the punch guide 9 at a time of bending the bending piece A of the raw material C, the slidable contact surface of the punch chip 25 with respect to the slidable contact surface 47 of the punch chip pressing member 49 is changed from the sliding surface 31 to the inclined surface 33, so that the punch chip 25 is slightly pressure moved to the protruding side of the bending process portion 29 (the left side in FIG. 1) against the energizing force of the elastic member 41.

Accordingly, as mentioned above, the bending piece A of the raw material C is over-bent (bent, for example, over 90 degrees) while taking the spring back into consideration.

Thereafter, when the ram 63 is moved upward, the upper metal mold 1 is returned to the original position on the basis of an operation of the lifter spring 11, and is returned to the original state on the basis of the operations of the stripper spring 21 and the elastic member 41.

As has been already understood, the bending piece A of the raw material C is over-bent so as to be along the inclined surface of the bending process edge 55. In other words, the bending piece A is bent in the downward direction over 90 degrees while taking the spring back into consideration. Accordingly, the bending angle (for example, 90 degrees) of the bending piece A forms an accurate bending angle.

When bending the bending piece A of the raw material C in the downward direction as mentioned above, the bending piece A is positioned within the die hole 51, so that it is hard to largely move the workpiece in the X-axis and Y-axis directions in the next step.

Accordingly, the workpiece W is pressure fixed to the lower metal mold 3 by positioning the micro joint D connecting the workpiece W and the raw material C at the position corresponding to the bending process edge 55 and thereafter moving downward the ram 63 again. Thereafter, the micro joint D is cut and separated by the bending process portion 29 in the punch chip 25, and the formed product B in a state in which the bending piece A is bent in the downward direction is dropped into the die hole 51.

As is understood from the description mentioned above, since the burr at a time of processing the slits S1 and S2 forming the raw material C and the burr at a time of processing the punching hole H are generated in the lower surface of the workpiece W, and the bending process of the bending piece A is thereafter executed in the downward direction, the generating side of the burr and the protruding side of the bending piece A are identical to each other. In other words, the protruding side of the bending piece A and the generating side of the burr can be set to the back surface of the formed product B, and it is possible to omit the deburring of the formed product B. Accordingly, it is possible to cancel the conventional problem as mentioned above.

The present invention is not limited to the embodiment as mentioned above, and can be realized in accordance with the other aspects by employing an appropriate change. For example, the following structure can be employed as the pressure moving mechanism for moving the punch chip 25 to the protruding side of the bending process portion 29 against the energizing force of the elastic member 41 at a time when the punch chip 25 is relatively moved downward with respect to the punch guide 9.

Figure 5:
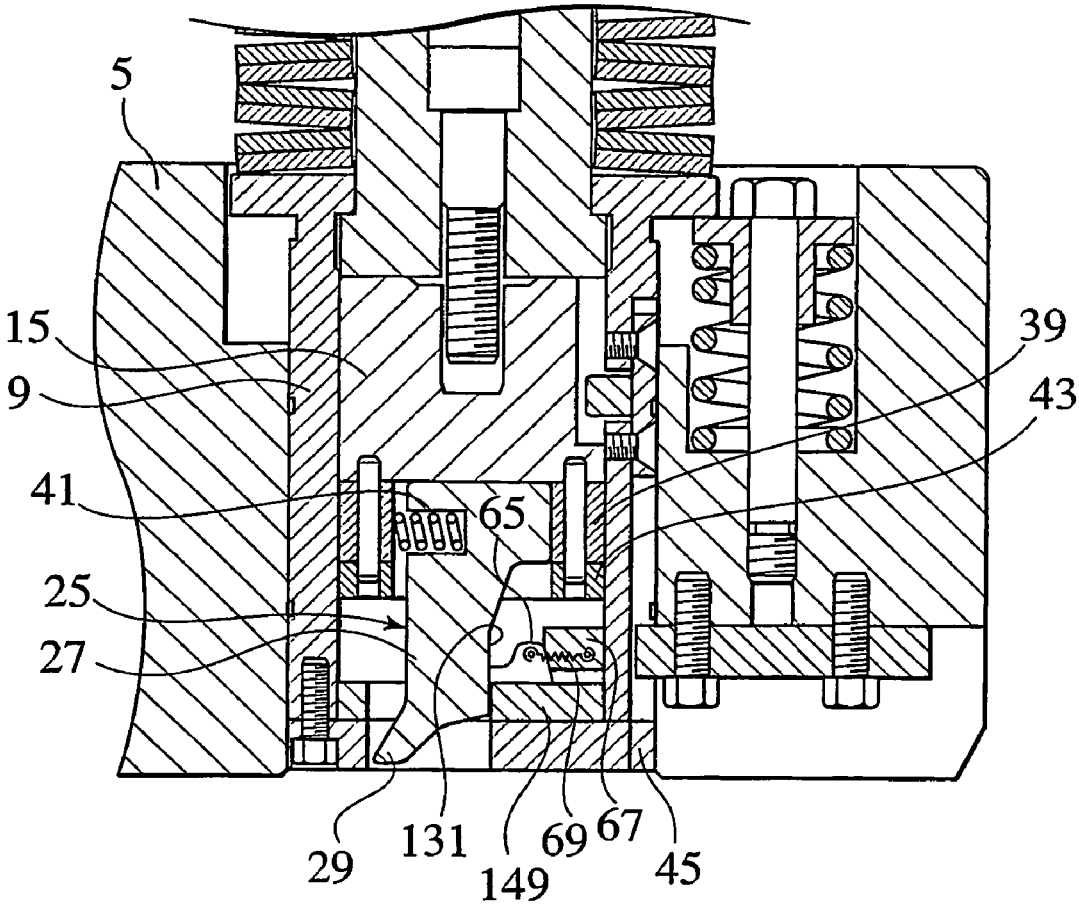
FIG. 5 is a cross sectional explanatory view of a main portion showing a second embodiment of the upper metal mold.

In other words, the structure may be made such that a pressing block 65 freely pressing the punch chip 25 is slidably provided, as shown in FIG. 5 showing a second embodiment of the metal mold 1, on an upper surface of the plate presser foot 45 or a punch chip guide member 149, a wedge block 67 allowed to be pressed down by the lower surface of the support member 43 is arranged between the pressing block 65 and the inner peripheral surface of the punch guide 9 so as to be movable upward and downward, and an elastic member 69 such as a tension spring is provided in a tensional manner between the pressing block 65 and the wedge block 67, for the purpose of holding an inclined surface of the pressing block 65 and an inclined surface of the wedge block 67 in a full-time contact state.

In the case of the present embodiment, an approximately vertical sliding surface 131 of the punch chip 25 is formed longer upward than the sliding surface 31 in accordance with the first embodiment mentioned above. Accordingly, even if the punch chip 25 is moved downward to a lower end position, a side surface of the punch chip guide member 149 neither is in contact with the inclined surface 33 (refer to FIG. 3B) nor slide.

In accordance with the structure mentioned above, in the case that the support member 43 fixed to the lower surface of the punch body 15 is brought into contact with the wedge block 67 so as to gradually move downward the wedge block 67 at a time of the bending process of the bending piece A of the raw material C, the pressing block 65 is gradually moved in a leftward direction in FIG. 5, and pressure moves the punch chip 25 in the leftward direction.

Therefore, in accordance with the structure mentioned above, when bending the bending piece A of the raw material C in the downward direction, it is possible to over-bend the bending piece A, and it is possible to achieve the same effect as mentioned above.

Figure 6A:
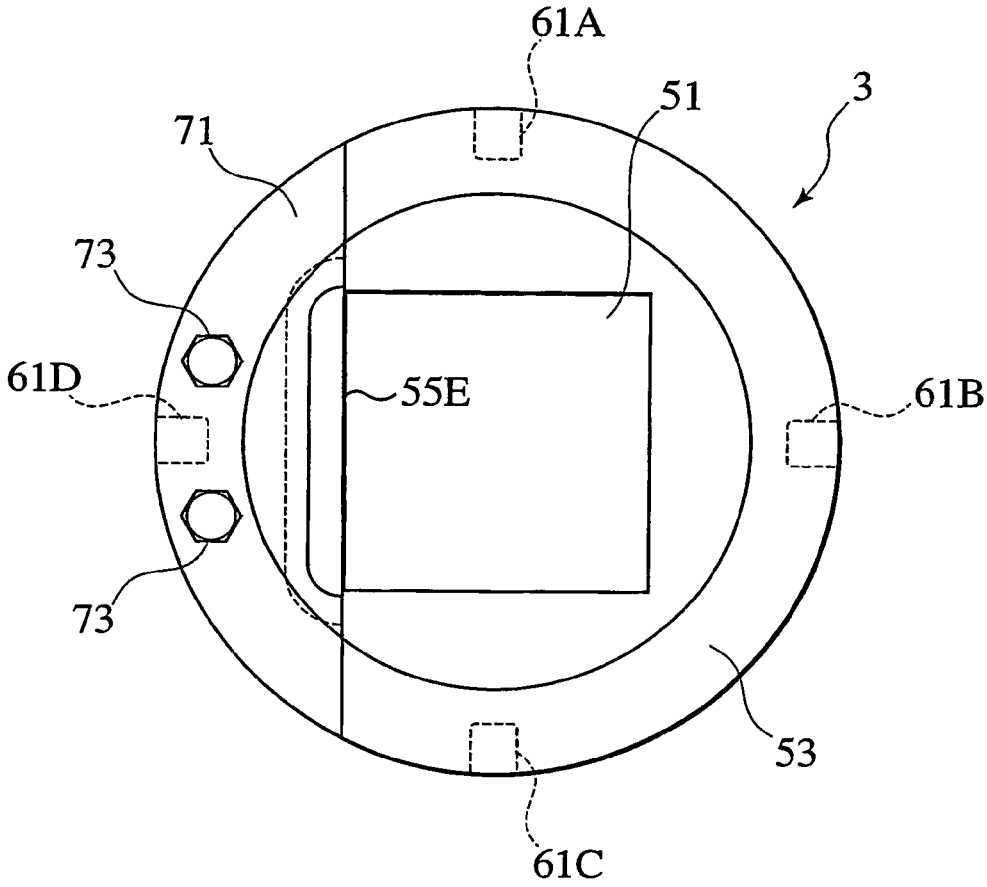
FIG. 6A is a plan view showing a second embodiment of the lower metal mold.
Figure 6B:
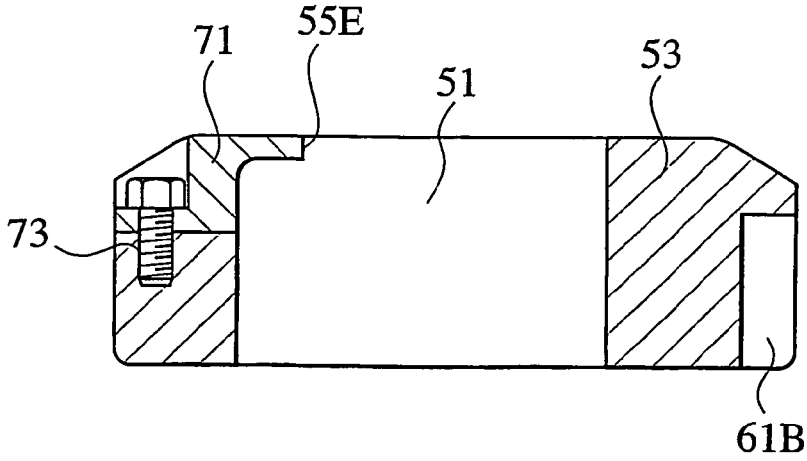
FIG. 6B is a cross sectional side elevational view showing a second embodiment of the lower mold.

Further, in the lower metal mold 3, as shown in FIGS. 6A and 6B showing a second embodiment of the lower metal mold 3, the structure may be made such that a die chip 71 provided with a bending process edge 55E at a position corresponding to the die hole 51 is attached to the die main body 53 by a fixing device 73 such as a plurality of bolts or the like so as to be detachable and replaceable.

In accordance with the structure mentioned above, the die chip 71 can be made of an expensive material, the die main body 53 can be made of an inexpensive material, and a processing accuracy of the die hole 51 may be rough, so that it is possible to inexpensively manufacture an entire structure.

Next, a description will be given of an embodiment of a processing method of a formed product in accordance with the present invention with reference to FIGS. 7A and 7B.

Figure 7A:
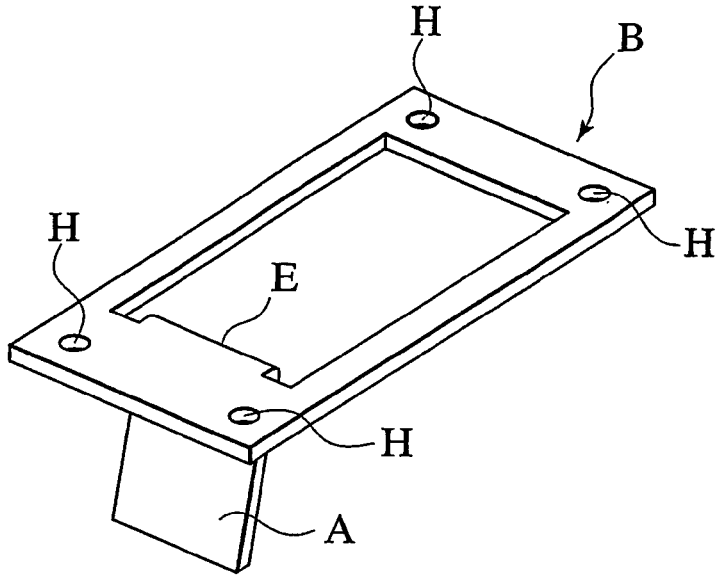
FIGS. 7A and 7B are explanatory views schematically showing a manufacturing step of a product formed by the upper metal mold and the lower metal mold in accordance with the present invention.

First, as shown in FIG. 7A, in the case of forming the formed product B provided with the punching hole H at the appropriate position and provided with the bending piece A protruding in one direction by the punch press, the following processing method is employed.

Figure 7B:
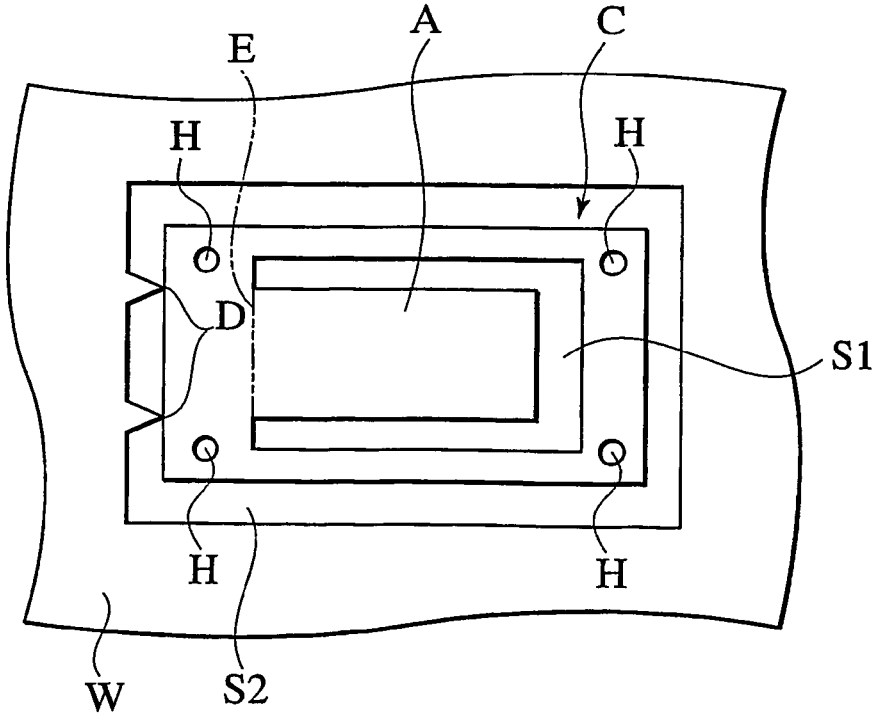

In a first step, the micro joint D connecting the workpiece W and the raw material C is left at a time of moving and positions the workpiece W in the X-axis and Y-axis directions with respect to the processing position of the punch press, executing the punching process of the punching hole H as shown in FIG. 7B, processing the slit S1 in the portion forming the bending piece A in accordance with the nibbling process or the like, and processing the slit S2 along the outer shape of the raw material C forming the formed product B. In this case, an nibbling metal mold or the like is used in the nibbling process or the like which is independent from the metal mold in accordance with the present invention.

At this time, when executing the punching process of the punching hole H and processing the slits S1 and S2 in accordance with the nibbling process or the like, the burr is generated in the lower surface of the workpiece W.

Next, in a second step, the raw material C is formed at a plurality of positions of the workpiece W by positioning the workpiece W at the processing position and repeating the slit process, and the formed product B is thereafter processed by bending the bending piece A at the bending position E by the metal molds 1 and 3 in accordance with the present invention. At this time, the bending piece A is bent in the downward direction, and the bending piece A enters into the die hole 51 of the lower metal mold 3.

Further, in a third step, the micro joint D connecting the workpiece W and the raw material C is positioned at the position corresponding to the bending process edge 55. In other words, the workpiece is moved in the rightward direction in FIG. 1 by the workpiece positioning mechanism of the punch press so as to be changed from a state in which the bending process edge 55 matches to the bending process portion E, to a state in which the micro joint D matches to the bending process portion E.

When again moving downward the ram 63 in the state in which the micro joint D matches to the bending process portion E, the workpiece W is pressure fixed to the lower metal mold 3. Thereafter, the micro joint D is cut and separated by the bending process portion 29 in the punch chip 25, and the formed product B in the state in which the bending piece A is bent in the downward direction is dropped below the lower metal mold 3 while passing through the inner side of the die hole 51.

Accordingly, the formed product having the bending piece A protruding to the lower side of the workpiece W is separated from the workpiece W, whereby it is possible to move the workpiece W in the X-axis and Y-axis directions without generating an interference between the bending piece A and the lower metal mold 3. Therefore, it is possible to smoothly carry out the process of the next formed product in the workpiece W.

Further, since the generating direction of the burr and the bending direction of the bending piece protrude to the same direction (the back surface) of the workpiece, it is possible to omit the deburring applied to the separated formed product, so that it is possible to improve a productivity.

The present invention is not limited to the embodiments mentioned above, but can be realized on the basis of the other aspects by employing an appropriate change.

Entire contents of Japanese Patent Application No. 2002-289207 (filed on Oct. 1, 2002) are included in the specification of the present application as reference.

The invention claimed is:

1. A method, of processing a product comprising:

separating a raw material for the product from a workpiece comprising the raw material by forming a slit in the workpiece while leaving a micro joint connection connecting the raw material and the workpiece, wherein the slit is defined by an outer periphery of the raw material and an inner periphery of the workpiece, and wherein the micro joint connection is positioned within the slit;

positioning a portion of the raw material on a lower metal mold and bending the portion of the raw material downward at an angle greater than 90° using an upper metal mold and the lower metal mold, while maintaining the micro joint connection between the raw material and the workpiece, and wherein the upper metal mold comprises:

a punch chip attached to a lower surface of a vertically movable punch body, wherein the punch chip is movable to a first side with respect to the punch body, and wherein the punch chip comprises a protruding bending process portion provided at a lower end of the punch chip so as to protrude to the first side; and dropping the product by separating the micro joint connection between the raw material and the workpiece.

2. The method according to claim 1, wherein the portion of the raw material is bent downward greater than 90° as the punch chip moves to the first side with respect to the punch body as the punch body is moved vertically.

3. The method according to claim 1, wherein the upper metal mold further comprises:

a pressure moving mechanism configured to move the punch chip to the first side when the punch body moves vertically.

4. The method according to claim 3, wherein the pressure moving mechanism comprises:

an inclined surface of the punch chip provided on a second side opposite the first side; and a punch chip pressing member provided in a lower portion of a punch guide, wherein the pressing member is configured to slide with the inclined surface of the punch chip.

5. A method of processing a product comprising:

separating a raw material for the product from a workpiece comprising the raw material by forming a slit in the workpiece while leaving a micro joint connection connecting the raw material and the workpiece, wherein the slit is defined by an outer periphery of the raw material and an inner periphery of the workpiece, and wherein the micro joint connection is positioned within the slit;

positioning a portion of the raw material on a lower metal mold and bending the portion of the raw material downward using an upper metal mold and the lower metal mold, while maintaining the micro joint connection between the raw material and the workpiece, wherein the lower metal mold comprises:

a die main body comprising a die hole; and a plurality of bending process edges provided at a plurality of positions in an inner peripheral edge of the die hole, wherein the portion of the raw material bent downward is bent downward along one of the bending process edges, wherein the micro joint connection between the raw material and the workpiece is separated along one of the bending process edges, and wherein each of a plurality of dimensions from a center of the die hole to the plurality of bending process edges is differentiated so as to correspond to a plurality of different workpieces having different thicknesses; and dropping the product by separating the micro joint connection between the raw material and the workpiece.

6. A method of processing a product comprising:

separating a raw material for the product from a workpiece comprising the raw material by forming a slit in the workpiece while leaving a micro joint connection connecting the raw material and the workpiece, wherein the slit is defined by an outer periphery of the raw material and an inner periphery of the workpiece, and wherein the micro joint connection is positioned within the slit;

positioning a portion of the raw material on a lower metal mold and bending the portion of the raw material downward into a die hole of a die main body using an upper metal mold and the lower metal mold, while maintaining the micro joint connection between the raw material and the workpiece; and dropping the product by separating the micro joint connection between the raw material and the workpiece.

7. The method according to claim 6, wherein the portion of the raw material is bent downward along a bending process edge of the die hole.

8. The method according to claim 7, wherein the bending process edge is provided as an inclined surface of the die hole of the die main body.

9. A method of processing a product comprising:

separating a raw material for the product from a workpiece comprising the raw material by forming a slit in the workpiece while leaving a micro joint connection connecting the raw material and the workpiece, wherein the slit is defined by an outer periphery of the raw material and an inner periphery of the workpiece, and wherein the micro joint connection is positioned within the slit;

positioning a portion of the raw material on a lower metal mold and bending the portion of the raw material downward using an upper metal mold and the lower metal mold, while maintaining the micro joint connection between the raw material and the workpiece; and dropping the product by separating the micro joint connection between the raw material and the workpiece, wherein the micro joint connection between the raw material and the workpiece is separated by bending the raw material downward along a bending process edge of a die hole of a die main body.

10. A method of processing a product, comprising:

separating a raw material for the product from a workpiece comprising the raw material by forming a slit in the workpiece while leaving a micro joint connection connecting the raw material and the workpiece;

positioning a portion of the raw material on a lower metal mold and bending the portion of the raw material downward at an angle greater than 90° using an upper metal mold and the lower metal mold, while maintaining the micro joint connection between the raw material and the workpiece, the upper metal mold comprising a punch chip attached to a lower surface of a vertically movable punch body, wherein the punch chip is movable to a first side with respect to the punch body, wherein the punch chip comprises a protruding bending process portion provided at a lower end of the punch chip so as to protrude to the first side and a pressure moving mechanism configured to move the punch chip to the first side when the punch body moves vertically, the pressure moving mechanism comprising an inclined surface of the punch chip provided on a second side opposite the first side and a punch chip pressing member provided in a lower portion of a punch guide, wherein the pressing member is configured to slide with the inclined surface of the punch chip; and dropping the product by separating the micro joint connection between the raw material and the workpiece.

11. A method of processing a product, comprising:

separating a raw material for the product from a workpiece comprising the raw material by forming a slit in the workpiece while leaving a micro joint connection connecting the raw material and the workpiece;

positioning a portion of the raw material on a lower metal mold and bending the portion of the raw material downward using an upper metal mold and the lower metal mold, while maintaining the micro joint connection between the raw material and the workpiece, the lower metal mold comprising a die main body comprising a die hole and a plurality of bending process edges provided at a plurality of positions within an inner peripheral edge of the die hole, wherein the portion of the raw material bent downward is bent downward along one of the bending process edges, wherein the micro joint connection between the raw material and the workpiece is configured to be separated along one of the bending process edges, and wherein each of a plurality of dimensions from a center of the die hole to the plurality of bending process edges is differentiated so as to correspond to a plurality of different workpieces having different thicknesses; and dropping the product by separating the micro joint connection between the raw material and the workpiece.

12. A method of processing a product, comprising:

separating a raw material for the product from a workpiece comprising the raw material by forming a slit in the workpiece while leaving a micro joint connection connecting the raw material and the workpiece;

positioning a portion of the raw material on a lower metal mold and bending the portion of the raw material downward using an upper metal mold and the lower metal mold, while maintaining the micro joint connection between the raw material and the workpiece, wherein the micro joint connection between the raw material and the workpiece is configured to be separated by bending the raw material downward along a bending process edge of a die hole of a die main body; and dropping the product by separating the micro joint connection between the raw material and the workpiece.

* * * * *